United States Patent [19]

McGrath, Jr.

[11] 4,196,371

[45] Apr. 1, 1980

[54] SHOCK-ABSORBING MEANS FOR MESH-CARRYING MEMBER OF A CATHODE RAY TUBE

[75] Inventor: Patrick J. McGrath, Jr., Cornelius, Oreg.

[73] Assignee: Tektronix, Inc., Beaverton, Oreg.

[21] Appl. No.: 893,632

[22] Filed: Apr. 5, 1978

[51] Int. Cl.[2] ..... H01J 19/48; H01J 29/02; H01J 29/82

[52] U.S. Cl. ..... 313/456; 313/269; 313/288; 313/482

[58] Field of Search ..... 313/456, 438, 404, 417, 313/482, 383, 390, 451, 288, 269, 378

[56] References Cited

U.S. PATENT DOCUMENTS

| | | | |
|---|---|---|---|
| 2,400,331 | 5/1946 | Bachman | 313/482 |
| 2,454,970 | 11/1948 | Lafferty | 313/456 X |
| 3,137,803 | 6/1964 | Ney et al. | 313/383 |
| 3,390,294 | 6/1968 | Day et al. | 313/383 |
| 3,560,779 | 2/1971 | May | 313/288 X |
| 3,708,714 | 1/1973 | Kimura | 313/427 X |
| 3,714,489 | 1/1973 | Johnson et al. | 313/417 |
| 3,983,444 | 9/1976 | Odenthal | 313/437 X |

*Primary Examiner*—Palmer C. Demeo
*Attorney, Agent, or Firm*—Adrian J. LaRue

[57] ABSTRACT

A cathode ray tube includes improved means for supporting scan expansion mesh electrode means, the supporting means comprising knitted metal mesh means in the form of metal braid secured to the mesh electrode means.

4 Claims, 7 Drawing Figures

SHOCK-ABSORBING MEANS FOR MESH-CARRYING MEMBER OF A CATHODE RAY TUBE

BACKGROUND OF THE INVENTION

Scan expansion mesh electrode means is a cylindrical metal member that is mounted onto ends of glass rods to which are mounted various elements of an electron gun means. Snubber springs are provided on the metal member and these springs engage the inner wall of the neck of the cathode ray tube to support the metal member, to align the metal member relative to the cathode ray tube axis and to provide shock absorption therefor.

It has been determined that these snubber springs do not provide optimum shock absorption and vibration resistance in a cathode ray tube. Shock loads to the cathode ray tube can cause bottoming out of the snubber springs. When the snubber springs bottom out as a result of a shock load to the cathode ray tube, the glass rods can engage the inside surface of the neck section thereby causing glass particles to be broken off the glass rods. These glass particles can float around the inside of the cathode ray tube and disrupt tube operation.

The snubber springs can take a permanent set as a result of being overstressed and this can misalign the scan expansion mesh electrode means thereby affecting tube operation.

It is therefore desirable to provide shock absorbing means to overcome the problems of snubber springs of scan expansion mesh electrode means.

SUMMARY OF THE INVENTION

The present invention relates to cathode ray tubes and more particularly to shock absorbing means for mesh-carrying means of the cathode ray tube.

The present invention is realized by securing braided or limited metal mesh onto mesh-carrying means. In one embodiment, the metal mesh is secured onto the section of the snubber springs that is secured to the mesh-carrying means and acts as a shock-absorbing means. In another embodiment, the metal mesh is secured around the mesh-carrying means and acts as a centering, supporting and shock-absorbing means. In a further embodiment, arcuate springs are provided along the mesh-carrying means and metal mesh is secured onto the arcuate springs.

An object of the present invention is to provide shock-absorbing means and vibration-damping means for mesh-carrying means of a cathode ray tube.

Another object of the present invention is the provision of mounting and aligning means and shock-absorbing means for a mesh-carrying means of a cathode ray tube.

A further object of the present invention is to provide shock-absorbing means disposed onto arcuate spring means on a mesh-carrying means of a cathode ray tube for mounting and aligning the mesh-carrying means within the cathode ray tube and for providing shock absorption therefor.

The foregoing and other objects and advantages of the present invention will become apparent from the following detailed description of preferred embodiments thereof and from the attached drawings.

DETAILED DESCRIPTION OF THE INVENTION

Figure 1:
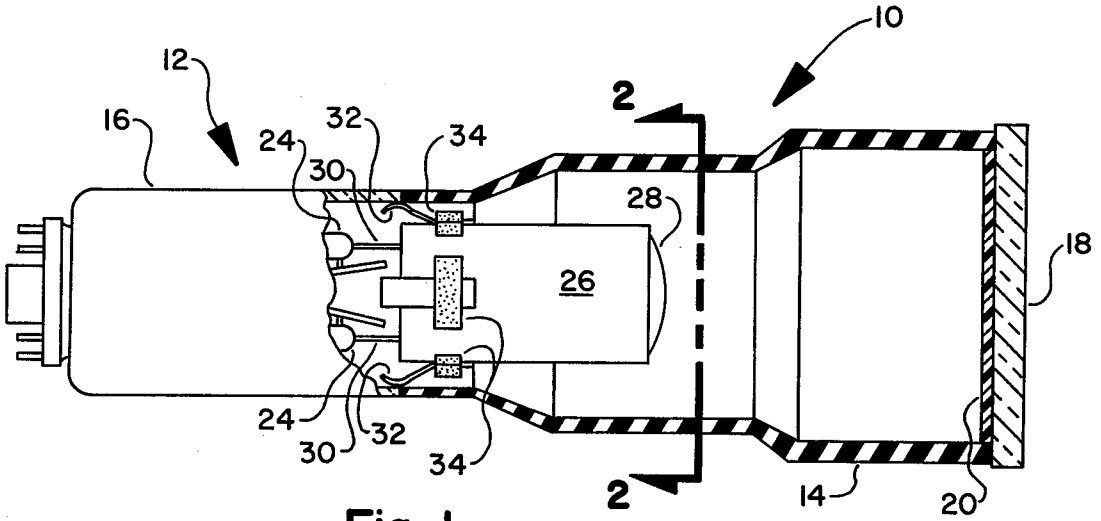
FIG. 1 is a longitudinal cross sectional view of a cathode ray tube showing part of the electron gun structure and the mesh-carrying member with shock-absorbing means thereon.
Figure 2:
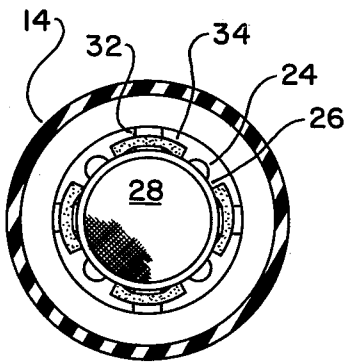
FIG. 2 is a view taken along lines 2—2 of FIG. 1.

Turning now to the drawings, a first embodiment of the invention is illustrated in FIGS. 1 and 2 which show a cathode ray tube 10 of conventional construction that comprises an envelope 12 including a funnel-shaped body section 14 and a neck section 16. Cathode ray tube 10 can take the form disclosed in U.S. Pat. No. 3,207,936 wherein body section 14 can be ceramic and neck section 16 can be glass that is sealed to the ceramic section. On the other hand envelope 12 can be made entirely of glass. A glass faceplate 18 having a phosphor screen 20 thereon is sealed to section 14.

Part of electron gun structure 22 is illustrated and its elements are mounted in glass rods 24 in a conventional manner. A cylindrical mesh-carrying electrode member 26 having a dome-shaped mesh 28 secured thereon is mounted on the ends of glass rods 24 via projections 30. Mesh 28 provides scan expansion of the electron beam. Snubber springs 32 extend outwardly from member 26 and they engage the inside surface of envelope 12 to properly align member 26 relative to the tube axis.

When the cathode ray tube is subjected to forces, such as dropping the tube, the tube being hit by something or the instrument carrying the tube being dropped or hit, the electron gun structure 22 including the mesh-carrying member 26 will move relative to envelope 12. If the force is such that mesh-carrying member 26 engages the envelope wall, glass particles can break off glass rods 24 due to the stresses being created on projections 22 or glass rods 24 in frictionally engaging the envelope wall cause glass particles to break loose from the glass rods or the envelope wall. These glass particles can be minutely small and float around the inside of envelope 12 affecting tube operation.

Misalignment of the electron gun structure can also occur if the forces are too great and a permanent set can happen in the snubber springs if they are overstressed and this will result in misalignment of the electron gun structure thereby affecting tube operation.

If the tube operation is affected too badly, the tube will have to be replaced with a new cathode ray tube. This is costly.

Rectangular-shaped shock-absorbing members 34 are secured onto snubber spring 32 and member 26 as by welding as they are formed of knitted or braided metal and this material can be obtained from the Cal-Metex Corporation, Torrance, California. These shock-absorbing members 34 will engage the envelope if the shock force is such to cause engagement and they will absorb a substantial amount of the energy generated by the shock force so as to prevent glass to glass contact or misalignment. Thus, shock-absorbing members 34 supplement the spring characteristics of snubber springs 32 to minimize the shock forces to the mesh-carrying member and electron gun structure of the cathode ray tube.

Figure 4A:
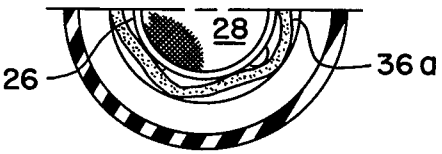
FIG. 4*a* is a view similar to FIG. 4 showing a further embodiment of the shock-absorbing means on the mesh-carrying member.
Figure 4:
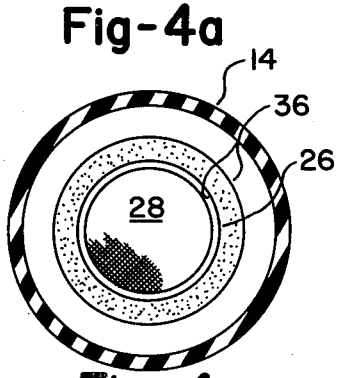
FIG. 4 is a view taken along lines 4—4 of FIG. 3.
Figure 3:
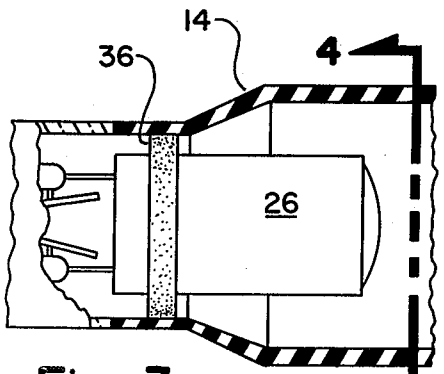
FIG. 3 is a view similar to FIG. 1 showing part of the cathode ray tube in section including part of the electron gun structure and the mesh-carrying member with an alternative embodiment of the shock-absorbing means therefor.

In the embodiment of FIGS. 3 and 4, the snubber springs have been replaced with a shock-absorbing member 36 which is an annular metal braid 36 which is secured onto mesh-carrying member 26. Member 36 has proper thickness so that mesh-carrying member 26 is properly positioned and aligned within neck section 16 and member 36 defines a mounting, aligning and shock-absorbing means for the mesh-carrying member and the electron gun structure. Braid 36*a* can also have a sinusoidal configuration as shown in FIG. 4*a*.

Figure 5:
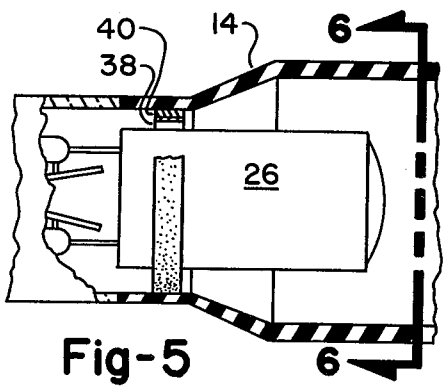
FIG. 5 is a view similar to FIG. 3 showing a further embodiment of the shock-absorbing means on the mesh-carrying member.
Figure 6:
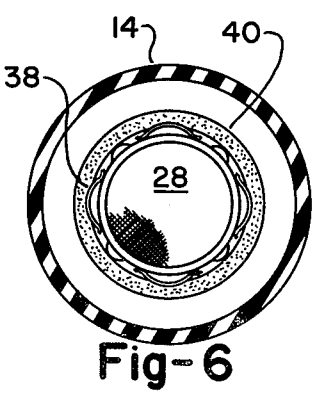
FIG. 6 is a view taken along lines 6—6 of FIG. 5.

As regards the embodiment of FIGS. 5 and 6, arcuate springs 38 have one end secured to mesh-carrying member 16 while the other end is free to move along the surface thereof. Annular shock-absorbing member 40 which is similar to member 36 of FIGS. 3 and 4 is secured onto arcuate springs 38 and the combination of member 40 and springs 38 define a mounting, aligning and shock-absorbing means for the mesh-carrying member and the electron gun structure.

It can readily be discerned from the foregoing that a unique shock-absorbing means for protecting the mesh-carrying member and electron gun structure of a cathode ray tube from undue shock forces has been disclosed. These shock-absorbing means also act as vibration-damping means.

While preferred embodiments of the present invention have been illustrated and described, it will be apparent that changes and modifications may be made to this invention without departing therefrom in its broader aspects. The appended claims therefore cover all such changes and modifications as fall therewithin.

The invention is claimed in accordance with the following:

1. In a cathode ray tube having a neck section and an electron gun structure including a mesh-carrying electrode member, the improvement comprising:

snubber spring means provided on the mesh-carrying electrode member; and metal mesh means secured onto said snubber spring means and an exterior surface of the mesh-carrying electrode member and being disposed between the mesh-carrying electrode member and an inside surface of the neck section for absorbing shock forces to the cathode ray tube to prevent the mesh-carrying electrode member from engaging the inside surface of the neck section.

2. In a cathode ray tube having a neck section and an electron gun structure including a cylindrical mesh-carrying electrode member, the improvement comprising:

metal mesh means secured onto an exterior surface of the mesh-carrying electrode member between the front and rear ends thereof and being disposed between the mesh-carrying electrode member and an inside surface of the neck section for absorbing shock forces to the cathode ray tube to prevent the mesh-carrying electrode member from engaging the inside surface of the neck section; and said metal mesh means being an annular member having sufficient thickness thereby defining mounting, aligning and shock-absorbing and vibration-damping means for the mesh-carrying electrode member.

3. In a cathode ray tube according to claim 2 wherein said metal mesh means has spaced sections of said metal mesh means connected to said mesh-carrying electrode member so that said metal mesh means has a sinusioidal configuration.

4. In a cathode ray tube having a neck section and an electron gun structure including a mesh-carrying electrode member, the improvement comprising:

arcuate-shaped spring means having one end secured to the mesh-carrying electrode member while the other end is movable relative thereto; and metal mesh means being in the form of an annular member and being secured onto said arcuate-shaped spring means, said arcuate-shaped spring means and said metal mesh means being disposed between the mesh-carrying electrode member and an inside surface of the neck section for absorbing shock forces to the cathode ray tube to prevent the mesh-carrying electrode member from engaging the inside surface of the neck section and defining mounting, aligning and shock-absorbing and vibration-damping means.

* * * * *

UNITED STATES PATENT AND TRADEMARK OFFICE

CERTIFICATE OF CORRECTION

PATENT NO. : 4,196,371

DATED : Apr. 1, 1980

INVENTOR(S) : Patrick J. McGrath, Jr.

It is certified that error appears in the above-identified patent and that said Letters Patent are hereby corrected as shown below:

Column 2, Line 63, change "spring" to --springs--.
Column 3, Line 19, change "16" to --26--.

Signed and Sealed this

*Eighth* Day of *July 1980*

[SEAL]

*Attest:*

SIDNEY A. DIAMOND

*Attesting Officer*

*Commissioner of Patents and Trademarks*